US008683718B2

(12) United States Patent
Fliri

(10) Patent No.: US 8,683,718 B2
(45) Date of Patent: Apr. 1, 2014

(54) FOOTWEAR HAVING INDEPENDENTLY ARTICUABLE TOE PORTIONS

(75) Inventor: Robert Fliri, Meran (IT)

(73) Assignee: Vibram S.p.A. (IT)

( * ) Notice: Subject to any disclaimer, the term of this patent is extended or adjusted under 35 U.S.C. 154(b) by 0 days.

(21) Appl. No.: 13/206,063

(22) Filed: Aug. 9, 2011

(65) Prior Publication Data

US 2012/0000094 A1 Jan. 5, 2012

Related U.S. Application Data

(63) Continuation of application No. 12/856,709, filed on Aug. 16, 2010, now Pat. No. 8,572,868, which is a continuation of application No. 11/526,987, filed on Sep. 26, 2006, now Pat. No. 7,805,860.

(60) Provisional application No. 60/720,750, filed on Sep. 26, 2005, provisional application No. 60/830,922, filed on Jul. 15, 2006.

(51) Int. Cl.
*A43B 7/26* (2006.01)

(52) U.S. Cl.
USPC ..... 36/94; 36/88; 36/9 R; 2/239; 2/409

(58) Field of Classification Search
USPC ..... 36/9 R, 113, 88, 93, 94; 2/239, 409
See application file for complete search history.

(56) References Cited

U.S. PATENT DOCUMENTS

| | | | | | |
|---|---|---|---|---|---|
| 3,013,564 | A | * | 12/1961 | Levey | 36/170 |
| 3,967,390 | A | * | 7/1976 | Anfruns | 36/94 |
| 4,651,354 | A | * | 3/1987 | Petrey | 2/239 |
| D382,690 | S | * | 8/1997 | Hirahata | D2/902 |
| D394,139 | S | * | 5/1998 | Hirahata | D2/902 |
| 5,774,898 | A | * | 7/1998 | Malpee | 2/239 |
| 5,913,592 | A | * | 6/1999 | Moore | 36/8.1 |
| D455,002 | S | * | 4/2002 | Holden | D2/916 |
| 7,082,703 | B2 | * | 8/2006 | Greene et al. | 36/89 |
| 7,805,860 | B2 | * | 10/2010 | Fliri | 36/94 |
| 2003/0172555 | A1 | * | 9/2003 | Chu | 36/113 |
| 2005/0166427 | A1 | * | 8/2005 | Greene et al. | 36/128 |

* cited by examiner

*Primary Examiner* — Marie Patterson
(74) *Attorney, Agent, or Firm* — Cantor Colburn LLP

(57) ABSTRACT

Footwear including a sole, an upper, and a securement arrangement configured to secure the footwear to the foot of a wearer, where the sole and the upper delimit individual toe portions configured to receive, retain, and allow independent articulation of corresponding individual toes of a foot inserted in the footwear, and where the sole includes contouring and curvature which intimately corresponds to the shape of the foot.

12 Claims, 11 Drawing Sheets

FOOTWEAR HAVING INDEPENDENTLY ARTICUABLE TOE PORTIONS

CROSS REFERENCE TO RELATED APPLICATION

This application is a continuation of U.S. patent application number 12/856,709 filed on 16 Aug. 2010 which is a continuation of U.S. patent application Ser. No. 11/526,987 filed on 26 Sep. 2006 which is related to and claims the benefit of U.S. Provisional Patent Application Ser. No. 60/720,750 filed on 26 Sep. 2005 and U.S. Provisional Patent Application Ser. No. 60/830,922 filed on 15 Jul. 2006, the contents of all of said applications are herein incorporated by reference in their entirety.

TECHNICAL FIELD OF INVENTION

The invention concerns footwear and, more particularly, footwear having provisions for allowing independent movement of a wearer's toes while providing comfort, protection, and enhanced haptic response.

BACKGROUND OF INVENTION

As is widely accepted, toe movement is essential to the efficient overall movement of the body. See, e.g.: www.posetech.com; "Kick Off Your Shoes and Run Awhile", Christopher McDougall, NY Times, 23 Jun. 2005; etc. Toe action and the overall haptic response of the foot upon the ground play an important role in walking, jogging, running, etc., and in providing and maintaining a person's bodily balance. Herein, "haptic response" is used to mean a tactile sense of response relating particularly to the sense of touch associated with the feet and lower legs with respect to the ground/surface.

Conventional shoes generally include a sole portion and an upper formed above the sole and attached to a periphery thereof. The sole is shaped to underlie the bottom of a wearer's foot from the heel area through the arch, ball of the foot, up to and even beyond the tips of the toes. The upper extends over the sole to delimit a cavity which receives the foot. A portion of the upper extends over the toe area of the sole to form a toe cap at the front portion of the shoe. When the shoe is worn, the toes extend into the toe cap and lie therein adjacent one another. In this way, the foot rests upon a thick sole the bottom of which is generally flat for providing even contact with the ground. That is, when the shoe is at rest, the sole is disposed flush against the ground.

When the conventional shoe is worn, the entire front toe cap portion acts as a single unit. The movement of the toe cap portion is generally limited to a pivoting action about the ball of the foot. That is, despite the various movements of the five toes disposed therein, the toe cap portion moves as a single unit in only one direction at a time.

In this way, the conventional shoe can limit the natural movements of the toes and thus effect the overall operation and performance of the foot. Additionally, the toe cap portion limits, if not restricts, the wearer's ability to spread his/her toes within the toe cap portion. This can lead to significant discomfort of the wearer. This discomfort is compounded when the toes are crowded into the toe cap portion.

Moreover, the thick sole of a conventional shoe isolates the natural contouring and curvature of the foot from the ground, thus minimizing the foot's haptic sensations with respect to the ground. This can cause a general disassociation between a person and the ground resulting the development of improper foot and/or toe action while walking, running, etc. and can be generally disadvantageous with respect to the person's balance, agility, and overall foot health.

Attempts have been made to provide footwear having individual portions which encapsulate each toe separately. See, for example, U.S. Pat. Nos. 3,967,390, 4,651,354, and 5,774,898. However, none of these have been successful in enabling free and independent toe articulation while at the same time providing enhanced comfort and increased haptic response along with a significant degree of foot and toe protection.

Further attempts have been made to contour the sole of a shoe to correspond to curvatures of the foot. See, for example, U.S. Pat. Nos. 4,989,349, 5,317,819, 5,544,429, 6,115,941, and 6,708,424. However, all of these teachings require an outsole and a mid-sole, the combined thickness of which separates the foot of the wearer from the ground, thus reducing haptic response. Additionally, these attempts are generally directed toward a shoe sole which has a generally planar bottom surface for flushly engaging the ground. As mentioned above, this configuration further degrades the haptic response provided by the shoe. Moreover, these references disclose a shoe having a conventional toe cap portion for containing all five toes in a restrictive single compartment. Therefore, independent articulation of toes is not permitted, therefore further degrading the wearer's haptic response and resulting in increased foot discomfort.

Thus, there is a need for footwear which is shaped to the natural contour of the feet and which allows independent intrinsic movement of the feet, and particularly the toes, in order to enhance performance of the foot, increase haptic response, and to bring increased comfort to the wearer and yet which still provides coverage and protection to the toes and to the remainder of the foot.

BRIEF SUMMARY OF THE INVENTION

The above discussed and other problems and deficiencies of the prior art are overcome or alleviated by the invention which provides a novel and nonobvious footwear.

Footwear including a sole, an upper, and a securement arrangement configured to secure the footwear to the foot of a wearer, where the sole and the upper delimit individual toe portions configured to receive, retain, and allow independent articulation of corresponding individual toes of a foot inserted in the footwear, and where the sole includes contouring and curvature which intimately corresponds to the shape of the foot.

The above-discussed and other features and advantages of the apparatus and method will be appreciated and understood by those skilled in the art from the following drawings and detailed description.

BRIEF DESCRIPTION OF THE FIGURES

Referring now to the drawings wherein like elements are numbered alike in the several FIGURES.

DETAILED DESCRIPTION OF THE PREFERRED EMBODIMENT

Figure 1:
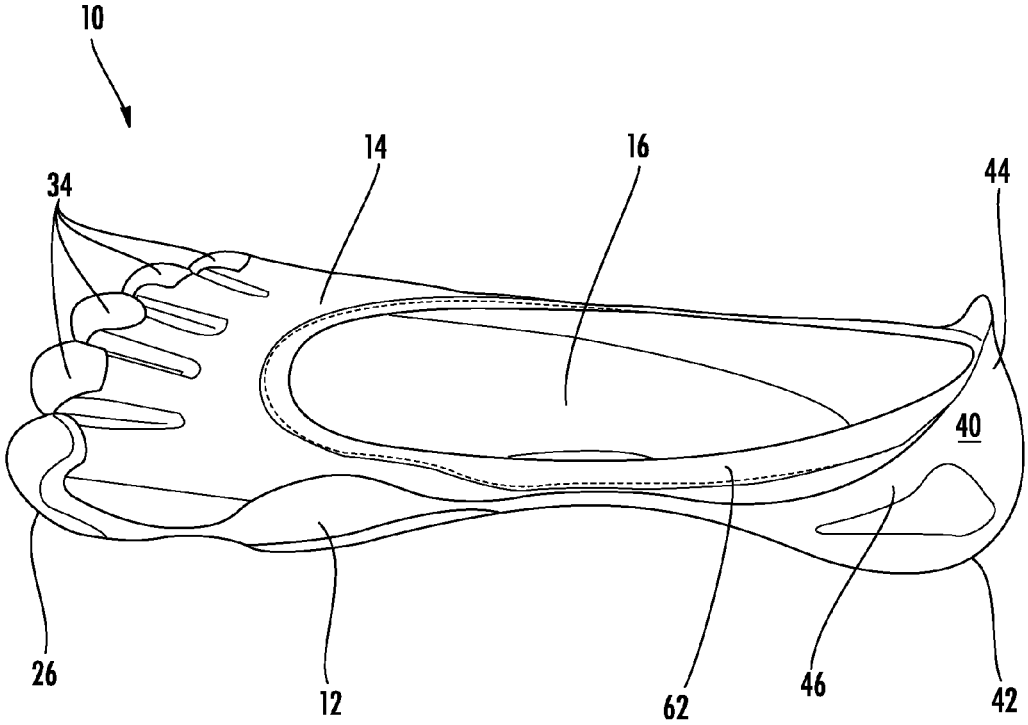
FIG. 1 shows a perspective view of a footwear according the invention.
Figure 2:
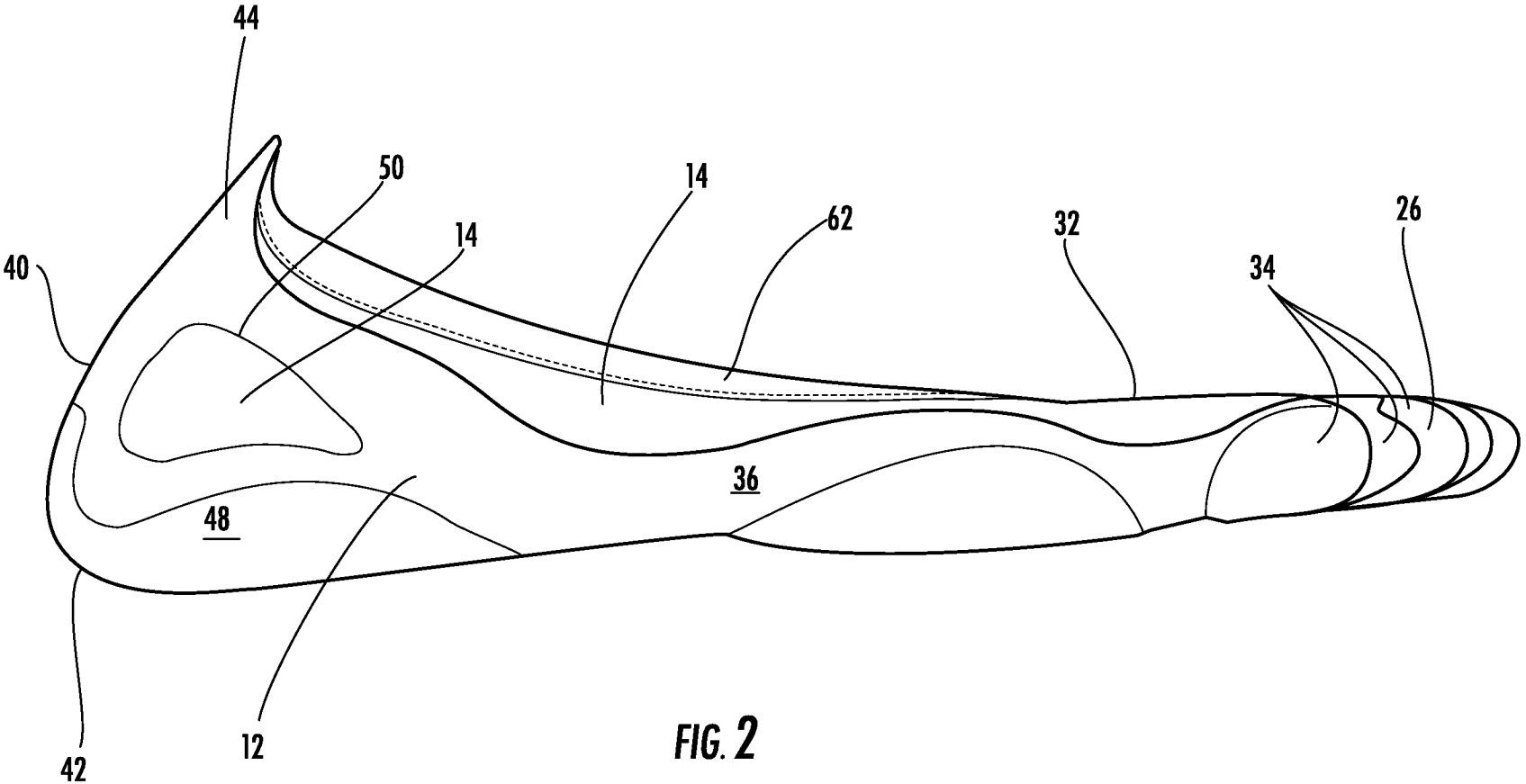
FIG. 2 shows a side elevation view thereof.

FIG. 1 shows a perspective view of a footwear 10 in one embodiment of the invention. The footwear 10 is generally composed of a sole 12 and an upper 14 attached to the sole 12 around a periphery of the sole 12. The footwear 10 further comprises an insole 16 disposed atop and attached to the sole 12. The insole 16 is also attached to the upper 14 at a periphery of the insole 16.

Figure 3:
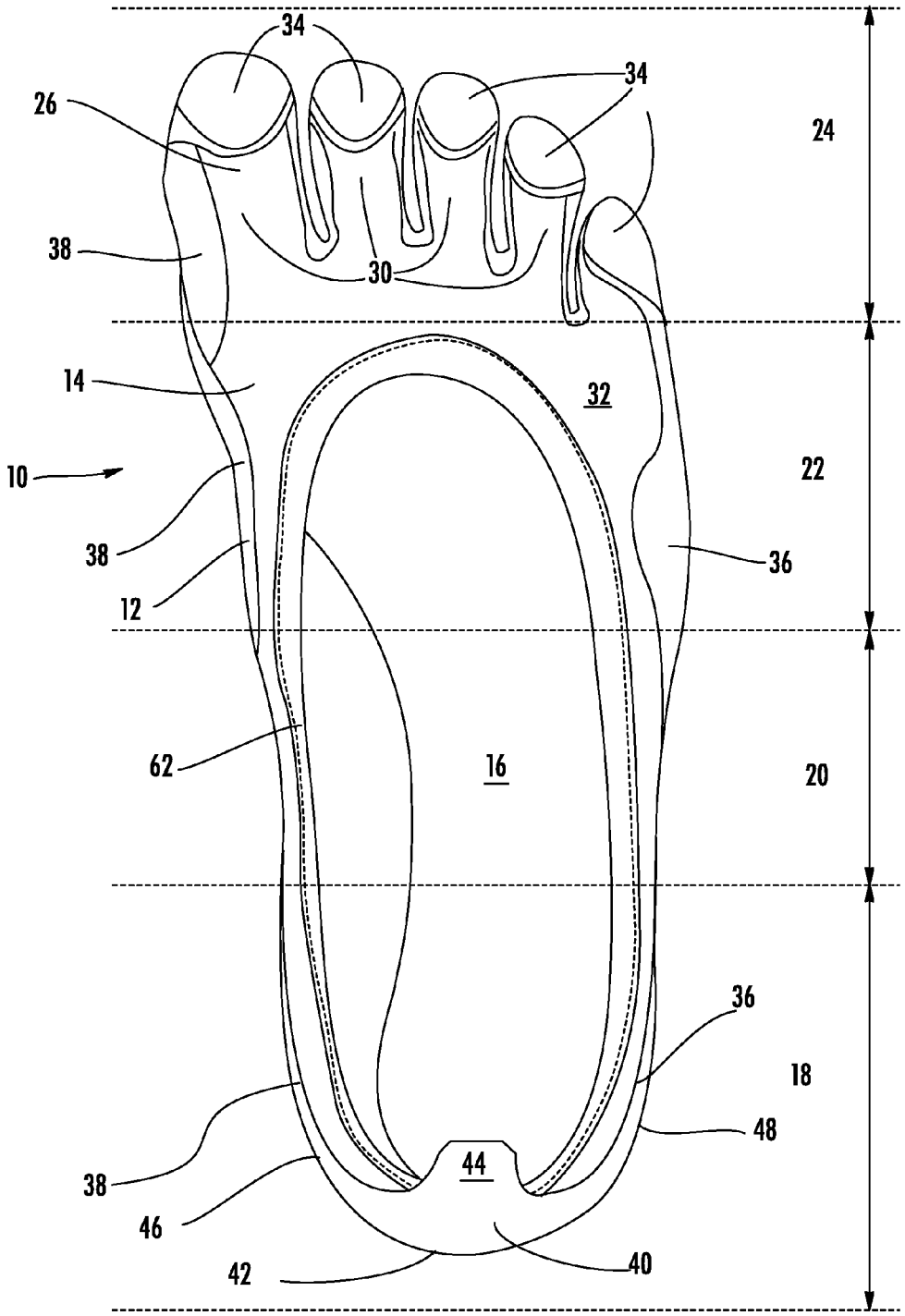
FIG. 3 shows a top plan view thereof.

As best shown in FIG. 3, the footwear 10 includes several regions which generally correspond to various parts of the foot. A rear foot portion 18 is disposed toward a rear of the footwear 10 and is generally configured for fitting around and supporting the heel of a wearer. A mid-foot portion 20 extends forward from the rear portion 18 and corresponds generally with the arch area of the foot. A fore-foot portion 22 extends forward of the mid-foot portion 20 and generally corresponds to the area of the ball of the foot, that is, the area proximate to the joining of the metatarsals and proximal phalanges. A front portion 24 is the forward most region of the footwear 10 and generally aligns with, supports, and protects the toes of the foot.

The front portion 24 of the footwear 10 includes individual toe portions 26 formed by a unique and intricate shaping of the sole 12, upper 14, and insole 16. The sole 12 includes splits 28 in the front portion 24 which delimit respective toe portions 26. See, particularly, FIG. 5. The upper 14 includes toe regions 30 which extend from a top 32 of the upper 14 downward to the periphery of the sole 12. That is, the toe regions 30 extend downwardly between the individual toe portions 26 and are affixed therein to the sole 12 along edges of the splits 28. The insole 16 includes respective toe portions (not shown) which are fixed to the toe portions 26 of the sole 12 and which extend into the toe portions 26.

The toe portions 26 are effectively individual cavities delimited by the intricate and unique shaping of the sole 12, upper 14, and insole 16. In use, the toes of the wearer each individually extend into the cavities of the toe portions 26.

The sole 12 generally includes various contouring to enhance the comfort and the protection provided by the footwear 10. For example, the sole 12 includes sole toe extensions 34 at the individual toe portions 26. The sole toe extensions 34 extend upwardly from the bottom of the footwear 10 at each of the toe portions 26 to meet the top 32 of the upper 14. As seen in FIG. 1, these sole toe extensions 34 actually extend atop the footwear 10 so as to be disposed above at least a portion of the toe nails of the toes of the wearer. Moreover, the sole toe extensions 34 extend laterally around sides of the toe portions 26. In this way, the toe extensions 34 of the sole 12 form individual toe caps on each of the toe portions 26 which protect the toes disposed therein at least partially from front, side, and top impacts.

The sole 12 further includes a lateral portion 36 and a medial portion 38 which extend upwardly on respective sides of the footwear 10. The lateral portion 36 of the sole 12 is disposed on an outer portion of the footwear 10 and extends from the outermost toe extension 34 of the sole 12 to a heel portion 40 of the sole 12. The medial portion 38 of the sole 12 is disposed on an inner portion of the footwear 10 and extends from the innermost toe extension 34 to the heel portion 40. The lateral portion 36 and medial portion 38 protect sides of the foot from side impact and exposure.

The heel portion 40 of the sole 12 includes a heel cup 42 which is configured for receiving and retaining the heel of the wearer. The heel portion 40 further includes an upper portion 44 extending upward from the heel cup 42 and opposing side portions 46 and 48 extending at sides of the heel cup 42 to meet the lateral portion 36 and the medial portion 38, respectively, of the sole 12. The sides of the heel portion 40 each include an opening 50 formed through the sole 12 which exposes the upper 14. The opening 50 of the sole 12 allows articulation of the heel portion 40 and provides ventilation to the rear portion 18 of the footwear 10. The sides 46 and 48 and the upper portion 44 of the heel 40 essentially wrap the heel and a portion of the ankle of the wearer with the durable, protective material of the sole 12.

Figure 5:
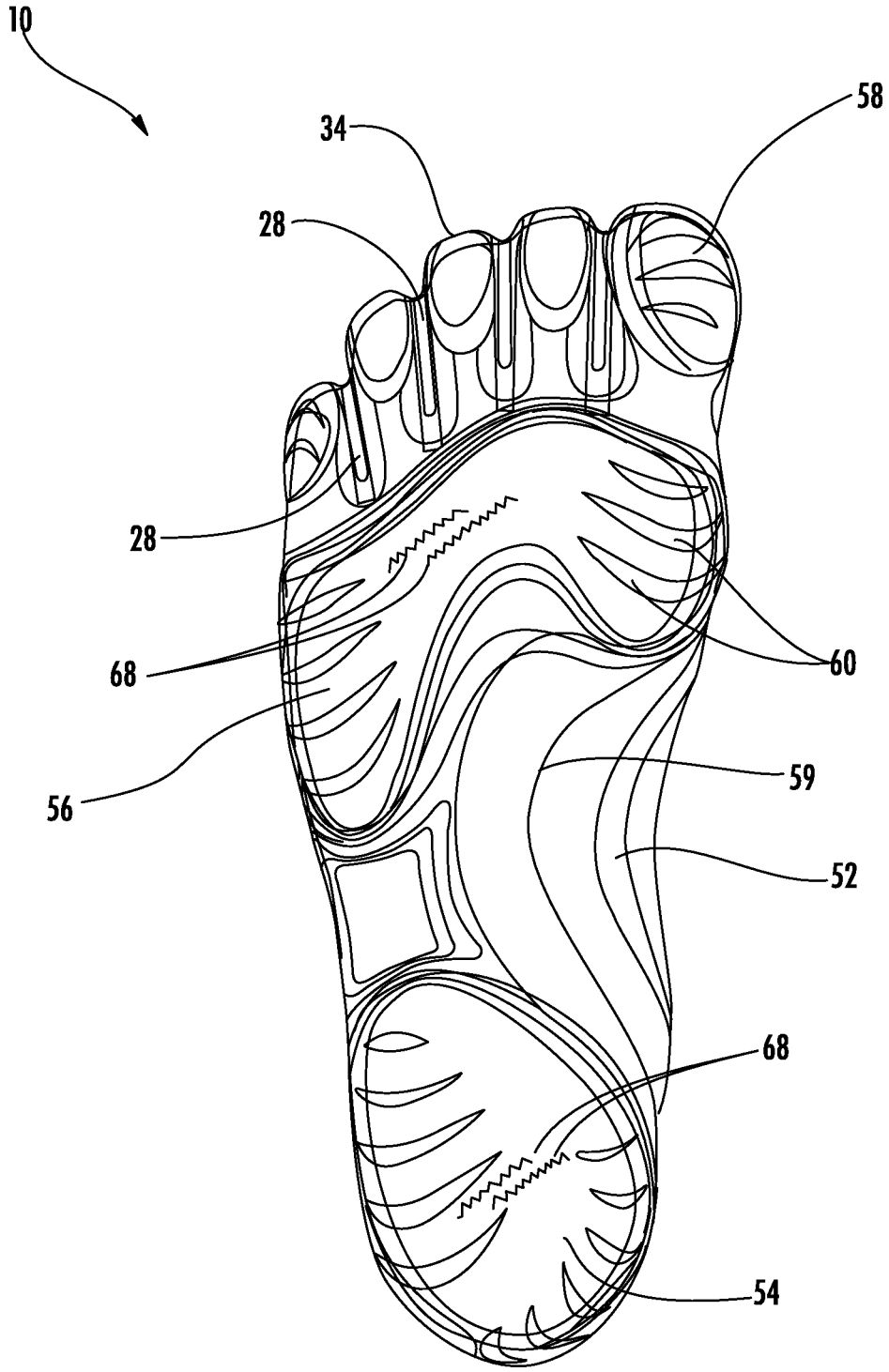
FIG. 5 shows a bottom view of the footwear of FIG. 1.

A bottom of the sole 12, as shown in FIG. 5, is shaped to compliment and correspond to the natural shape and configuration of the foot. The sole 12 includes an arch 52 at the mid-foot portion 20 proximate to the medial side 38. The sole 12 further includes a heel pad 54 and a fore-foot pad 56 respectively disposed at the rear portion 18 and at the fore-foot portion 22 of the sole 12. Additionally, the sole 12 includes toe pads 58 at each of the toe portions 26. The pads 54, 56, and 58 comprise areas of the sole 12 which are contoured to replicate the natural pads formed at the bottom of the feet. The precise contouring and curvature of the pads 54, 56, and 58, and of the remaining portions of the bottom of the sole 12, are shown by contour lines 59. The pads 54, 56, and 58, may be integrally formed with the sole 12, i.e., the material forming the sole 12 is made thicker in designated areas in order to delimit the pads 54, 56, and 58. Alternatively, the pads 54, 56, and 58 may be formed separately form the sole 12 and mounted thereon by adhesive bonding, thermal bonding, etc. In use, the heel pad 54, fore-foot pad 56, and toe pads 58 serve to support and protect the bottom of the foot of a wearer to walking, running, etc. Additionally, the contoured effect of the pads 54, 56, and 58 provide the wearer with the natural feeling of walking, running, etc. in the barefoot state.

Still further alternatively, the sole 12 may be formed with a consistent thickness throughout and may simply be molded and shaped so as to mimic and trace the natural pads and contouring of the foot. That is, the sole may be of uniform thickness and may include contouring 59 in order to precisely trace and conform to the natural shape and curvature of the foot.

The contouring 59 of the sole 12 provides the wearer with the natural feeling of walking, running, etc. in the barefoot state. The sole 12 is merely a thin layer providing sufficient protection of the foot from hazards on the ground but yet is sufficiently thin to provide the wearer with a direct and enhanced haptic response relative to the ground. That is, the thinness of the sole and its precise conformity to the natural shape of the foot (especially with respect to the individual toe portions 26, pad areas 54, 56, 58, and arch 52) allow for an increased and enhanced tactile engagement of the foot upon the ground. In this way, the foot is allowed to move upon the ground naturally, as if barefoot, but yet the foot remains protected by the unique footwear 10.

The bottom of the sole 12 further includes traction features 60 disposed at various areas on and extending in various directions across the sole 12. These traction features 60 may comprise indentations of various sizes and/or shapes formed into the sole 12 so as to provide traction to the wearer. Further, the fraction features 60 may comprise narrow lines cut into the bottom of the sole 12 which open to a greater width when the sole 12 is flexed during walking, running, etc. so as to provide traction during movement of the wearer.

Figure 6:
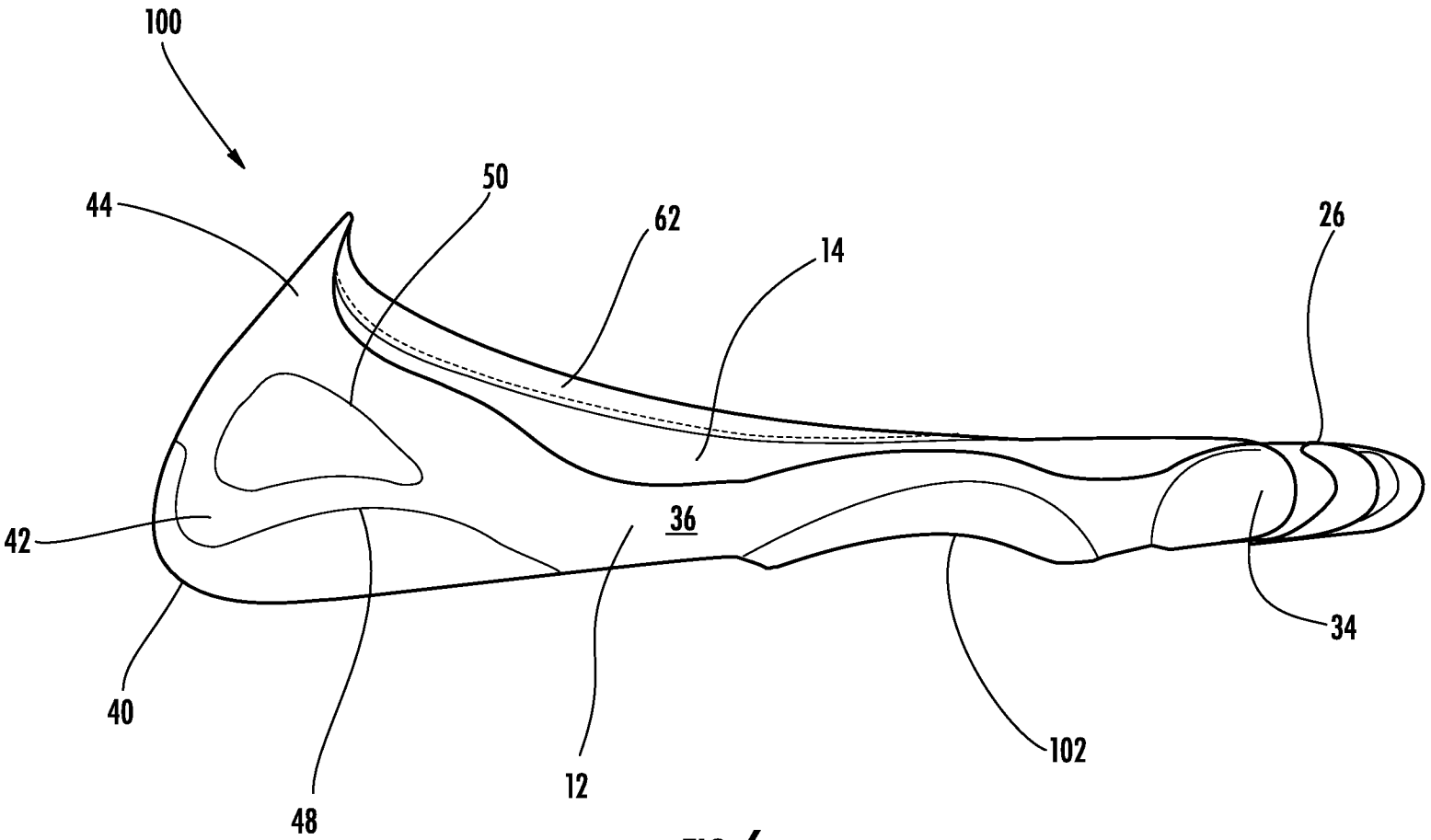
FIG. 6 shows a side elevation view of a footwear in another embodiment according to the invention.

The bottom of the sole 12 further includes razor cut siping 68 disposed at various areas on and extending in various directions across the sole 12. This siping 68 comprises narrow lines or slits cut or otherwise formed into the bottom of the sole 12. The siping is configured to open to a greater width when the sole 12 is flexed during walking, running, etc., so as to provide increased flexibility of the sole 12. That is, the siping 68 acts as a plurality of hinges which allow for articulation of the sole 12 during use and movement of the footwear 10. Additionally and/or alternatively, the siping 68 providing increased gripping and traction of the sole 12 during use and movement of the footwear 10. The siping 68 may be disposed regularly across the entire surface area of the bottom of the sole 12 or may be disposed in discrete areas, as desired. The individual lines/slits forming the siping 68 may be shaped in a longitudinal manner, or may be curved, angled, etc. An exemplary "zig-zag" siping pattern 60 is shown in FIG. 6. The siping 68 is shown in FIG. 6 as being disposed is random representative areas on the bottom of the sole 12. This disposition of the siping 68 is merely exemplary and, as stated above, the siping may be formed as and where desired across the sole 12.

The razor cut siping 68 contributes to the overall enhanced haptic response provided by the foot wear 10. As described, the siping 68 provides the sole with increased flexibility. This advantageously allows the sole 12 to bend and flex in immediate response to movements of the foot. Thus, as stated previously, the wearer of the footwear 10 is provided with a feeling of being barefoot but yet is protected from ground hazards by the unique footwear 10.

The upper 14 includes a collar 62 extending around an opening though which the wearer inserts the foot into the footwear 10. The collar 62 may include an element (not shown) which draws the upper 14 toward the foot of the wearer to keep the footwear 10 securely on the foot. The element of the collar 62 may comprise an elastic element which pulls the upper 14 toward the center of the opening. Additionally and/or alternatively, the element of the collar 62 may comprise a lace which may extend partially from the collar 62 such that the lace may be drawn up to tighten the upper about the foot of the wearer.

Figure 4:
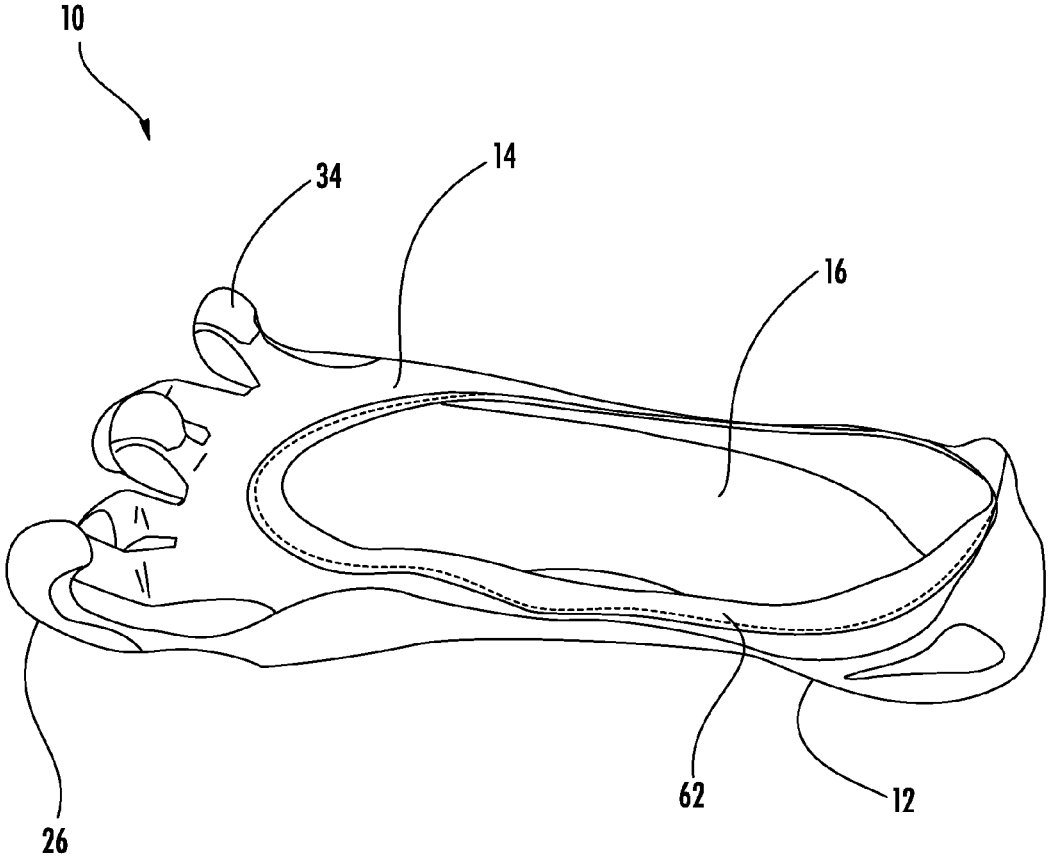
FIG. 4 shows a perspective view thereof with toe portions in an articulated position.

FIG. 4 shows the full, free, and independent articulation of the toe portions 26. As described, these toe portions 26 extend around each individual toe of the wearer to permit independent articulation thereof.

In an alternate embodiment of the invention, two or more of the toe portions 26 may be partially or completely connected together. For example, two or more toe portions 26 may be connected by a webbing which extends between the portions 26. Alternatively, one or more of the toe portions 26 may be configured to contain two or more corresponding toes of the wearer. Such configurations would allow independent toe articulation and continue to provide comfort and protection to the feet of the wearer.

Figure 7:
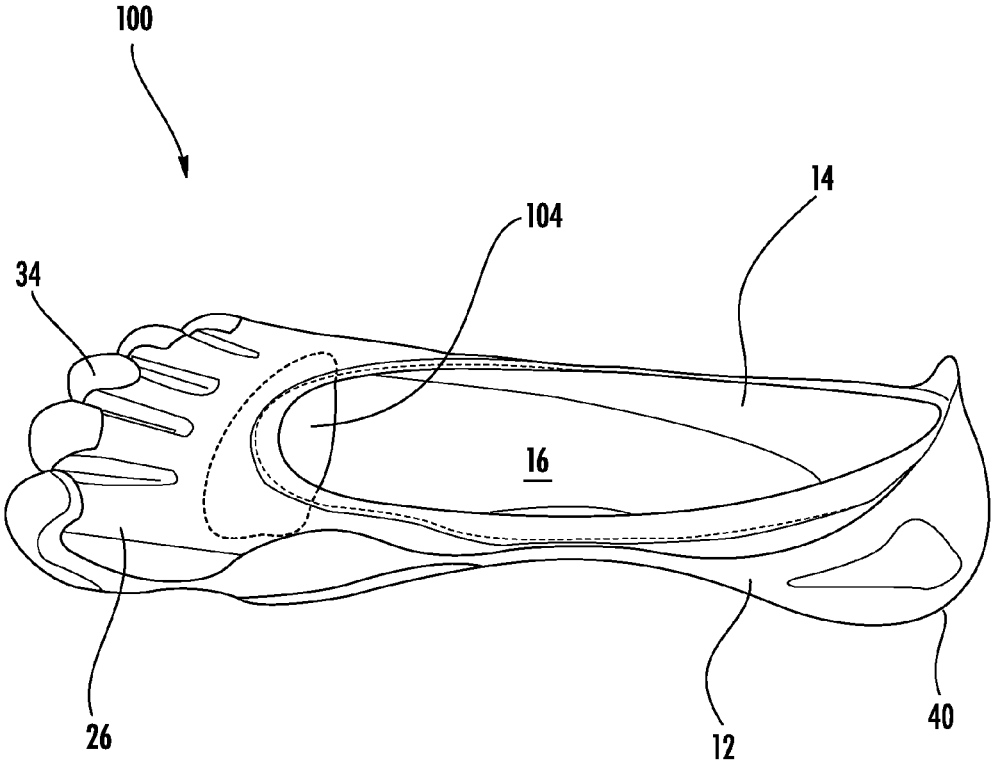
FIG. 7 shows a perspective view thereof.
Figure 8:
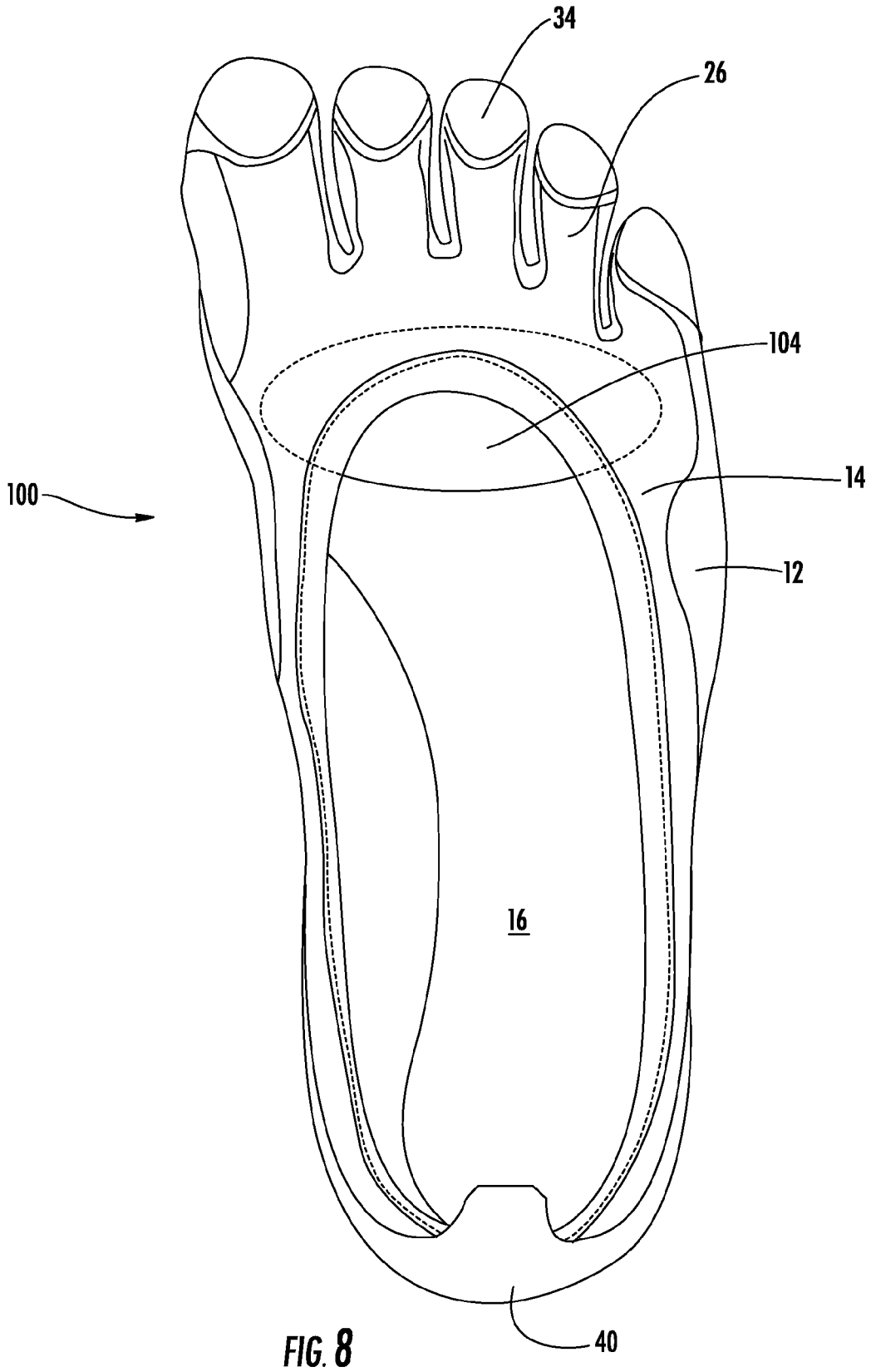
FIG. 8 shows a top plan view thereof.

FIGS. 6-8 show a footwear 100 in an alternate embodiment of the invention. Elements of the footwear 100 which are consistent with those discussed regarding the footwear 10 are indicated herein by consistent reference numerals and, for sake of brevity, are not reintroduced nor discussed in great detail; instead references is made to the foregoing descriptions.

The footwear 100 is substantially similar to the footwear 10 discussed herein above. However, the sole 12 of the footwear 100 includes a concavity 102 formed in the fore-foot portion 22 of the footwear 100. The sole 12 further includes a corresponding convexity 104 protruding upward into the foot cavity formed by the upper 14 and the sole 12. The convexity 104 is shown in FIGS. 7 and 8 and generally comprises a rounded element disposed in the fore-foot portion 22 of the footwear 100. The shape of the convexity 104 and the location of the convexity 104 within the footwear 100 are shown in the drawings by way of example only. The convexity 104 may assume any desired shape and may be formed in any desired position on the sole 12. When the footwear 100 is worn, the convexity presses gently at the underside of the wearer's foot when minimal weight is placed on the sole 12. This gentle upward pressure of the convexity 104 provides a soothing, comfortable feeling to the wearer. When the wearer places weight upon the sole 12 at the convexity 104, the convexity 104 deflects outward into the concavity 102 and does not impede the wearer's movement and/or balance. Additionally, the gentle upward force provided by the convexity 104 at or just prior to applying weight thereto can serve to splay the toes of the wearer for added comfort and/or to provide enhanced contact with the ground.

The concavity 102 and convexity 104 of the footwear 100 are formed as integral parts of the sole 12. That is, the sole 12 is shaped to include an upward projection on the bottom of the sole 12 which forms the concavity 102 at the bottom and the complementary convexity 104 at the top of the sole 12. The degree of the concavity 102 and the convexity 104, i.e., the depth and shape of the concavity 102 and the upward projection and shape of the convexity 104, may vary as desired to achieve the above-discussed comfort and haptic advantages. For example, in one embodiment, the concavity 102 may have a smooth outer surface which curves arcuately having a central apex of approximately ⅛ inch to approximately one inch. The corresponding convexity 104 may have a smooth outer surface for contacting the foot of a wearer or the convexity 104 may include one or more protrusions formed on the outer surface for providing a soothing massaging effect upon contacting the foot of the wearer. Other such variations of the size, shape, and contour of the concavity 102 and the convexity 104 are within the broad scope of the invention.

For example, in another embodiment, the bottom of the sole 12 of the footwear 100 may appear as described above with reference to the footwear 10 and the convexity 104 may simply be formed at the top side of the sole 12. That is, the top of the sole 12 of the footwear 10 may be formed to include a feature in relief which delimits the convexity 104, while the bottom of the sole 12 maintains the contouring of the pads 54, 56, and 58 discussed above.

The upper 14 of the footwear 10 and 100 is formed of any type of pliable material suitable for providing both comfort and a degree of protection to the foot of the wearer. For example, the upper 14 may comprise a cloth, a rubber material, a plastic material, neoprene, leather, a mesh material, etc., or a combination thereof, etc. The upper 14 may sewn, stitched, adhered, etc. onto the sole 12. The sole 12 is formed of any material suitable for protecting the bottom of the wearer's feet and for providing sufficient flexibility for movement of the foot and toes. For example, the sole may be formed of a rubber material, a plastic material, leather, cloth, compressed EVA, polyurethane, etc., or a combination thereof, etc.

Figure 9:
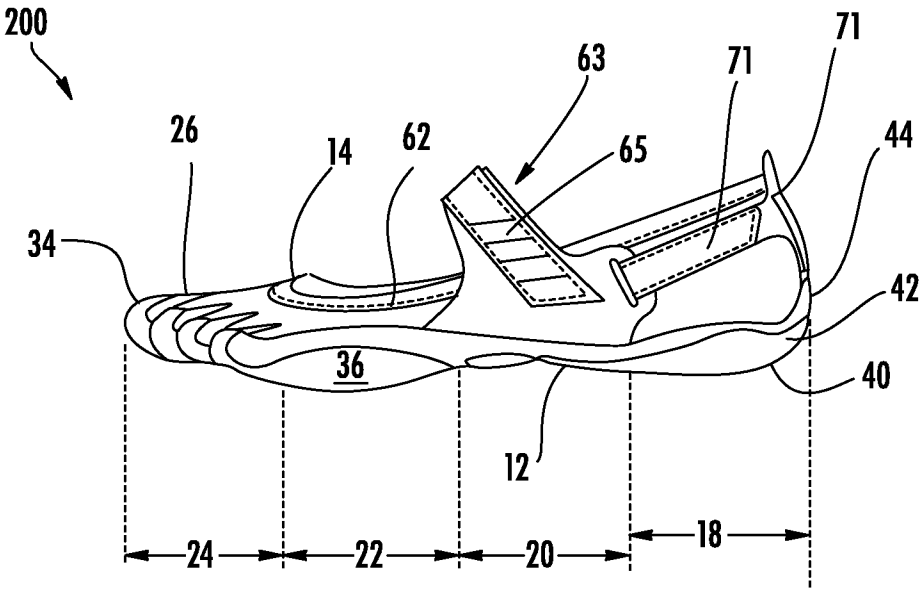
FIG. 9 shows a side elevation view of a footwear in another embodiment according the invention.
Figure 10:
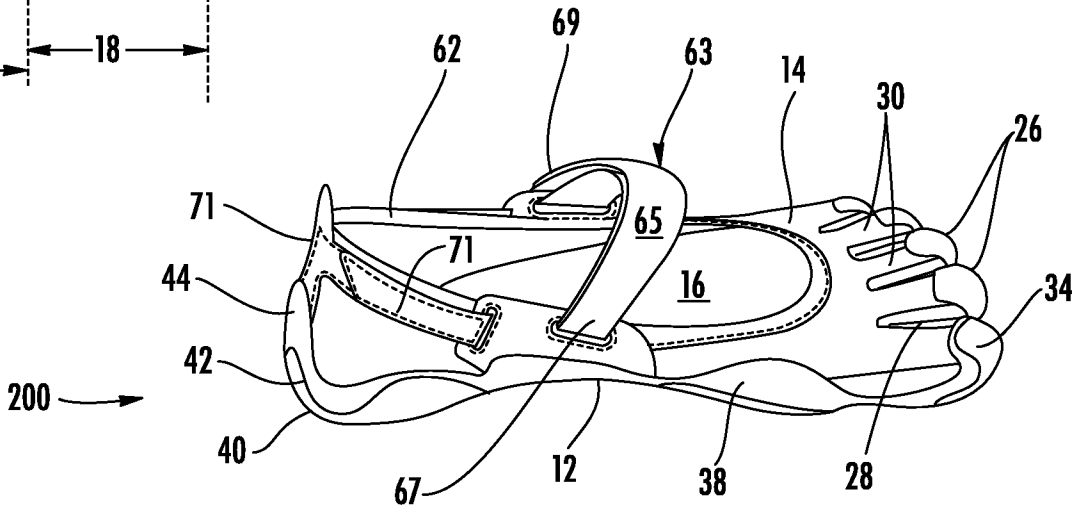
FIG. 10 shows a perspective view thereof.

FIGS. 9-10 show elevation and perspective views, respectively, of a footwear 200 in another embodiment of the invention. Elements of the footwear 200 which are consistent with those discussed regarding the footwear 10 and/or 100 are indicated herein by consistent reference numerals and, for sake of brevity, are not reintroduced nor discussed in great detail; instead references is made to the foregoing descriptions.

The footwear 200 is generally composed of the sole 12 and the upper 14 attached to the sole 12 around a periphery of the sole 12. The footwear 200 further comprises the insole 16 disposed atop and attached to the sole 12 with the insole 16 attached to the upper 14, all as generally discussed above. As best shown in FIG. 9, the footwear 10 includes the several regions which generally correspond to the various parts of the foot: the rear foot portion 18 disposed toward a rear of the footwear 200; the mid-foot portion 20 extends forward from the rear portion 18; the fore-foot portion 22 extends forward of the mid-foot portion 20; and the front portion 24. The front portion 24 of the footwear 200 includes the individual toe portions 26

The upper 14 of the footwear 200 further includes a securement arrangement 63 for positively fastening the footwear 200 upon the foot of a wearer. The securement arrangement 63 comprises, in one non-limiting exemplary embodiment, a strap 65 disposed in engageable association with the upper 14 so as to extend over the instep of the foot of a wearer. The strap 65 includes opposite ends 67, 69 which are fixed to the upper 14 during use of the footwear 10 to provide securement thereof to the foot. One or both of the ends 67, 69 of the strap 65 may be permanently fixed or removably attached to the upper 14. Removable attachment may be provided by a buckle, Velcro, tie, snap, or any other type of attachment configuration. The strap 65 may be formed of the same material as the upper 14 or may vary. The strap 65 may be composed of an elastic material so that it may stretch atop the instep of the wearer to provide a snug fit. Additionally and/or alternatively, the strap 65 may be configured tightened prior to fastening by way of any of a plurality of known techniques in order to provide a snug securement of the footwear 200 to the foot. The strap 65 may be fixed in a disposition relative to the upper 14 and sole 12 as shown in FIGS. 9-10 or the strap 65 may be disposed movably (for example, by way of hinge arrangement at one or more of the ends 67, 69) relative to the upper 14 and sole 12 so that the strap may pivot with respect thereto.

The securement arrangement 63 of the footwear 200 further includes a heel cuff 71 attached to the upper 14 (or comprising an integral portion thereof) which essentially wraps and/or encases one or more of the heel, Achilles tendon, and ankle portion of the foot of a wearer. In the embodiment of FIGS. 9-10, the heel cuff 71 is shown extending generally from the strap 65 rewardly toward the extension 44 of the heel cup 42. The strap 65 and heel cuff 71 may optionally be configured such that the strap 65 may be manually tightened across the instep of the foot of the wearer and such that this tightening also tightens the heel cuff 71 around one or more of the heel, Achilles, and ankle portions of the foot.

Figure 12:
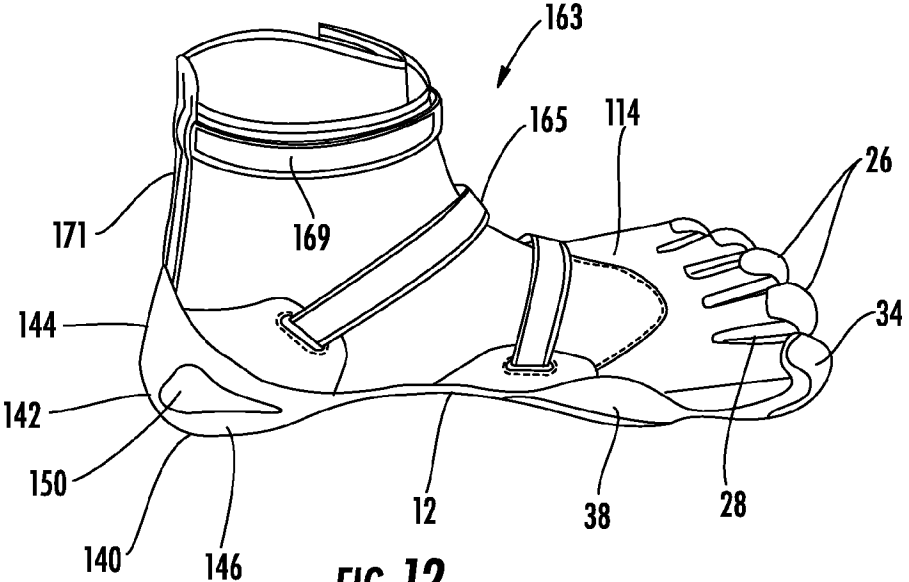
FIG. 12 shows a perspective view thereof.
Figure 11:
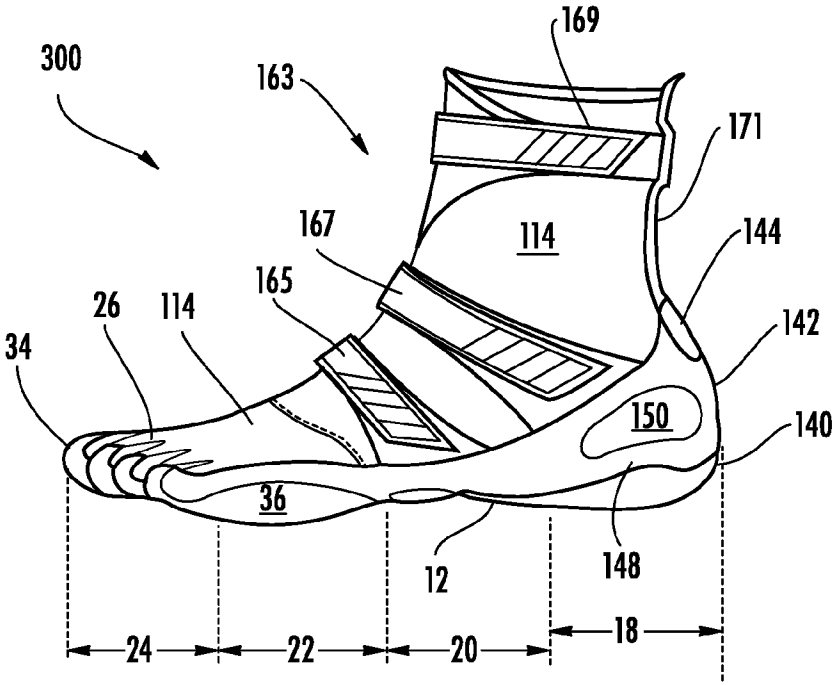
FIG. 11 shows a side elevation view of a footwear in another embodiment of the invention.
Figure 13:
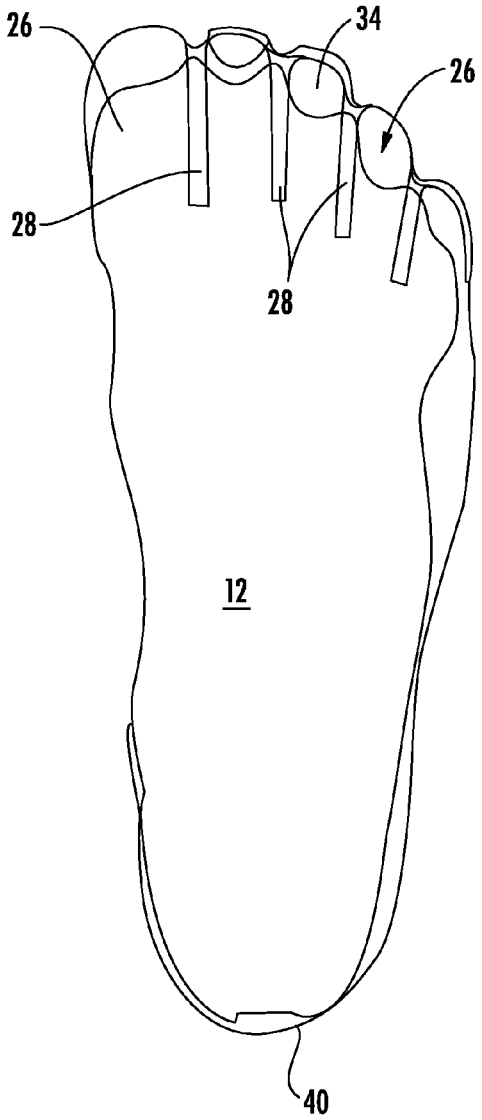
FIG. 13 shows a top plan view of a sole of the footwear of FIGS. 9-12.
Figure 14:
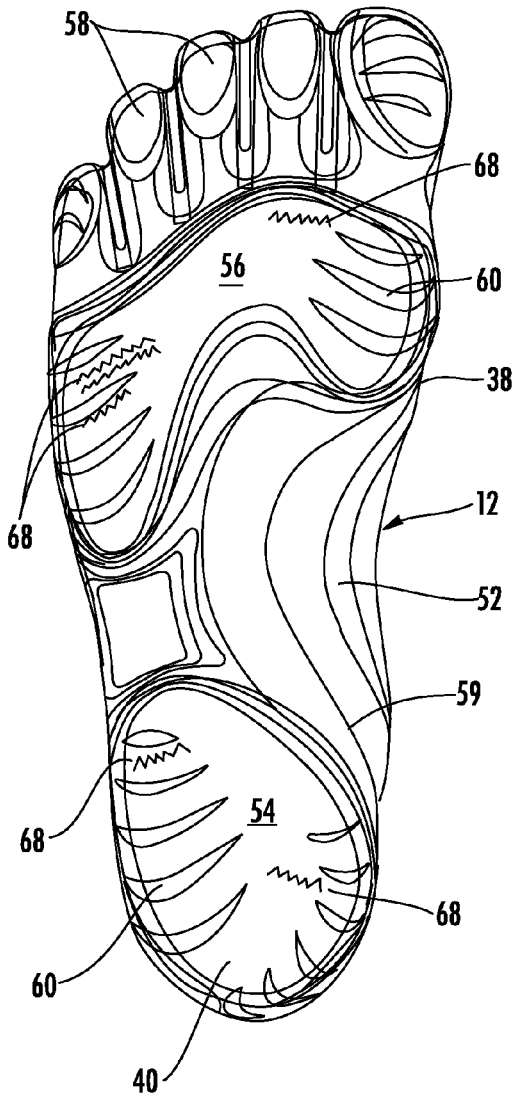
FIG. 14 shows a bottom plan view thereof with contour lines showing the contouring and curvature of the bottom of the sole.

FIGS. 11-12 show a footwear 300 in an alternate embodiment of the invention. Elements of the footwear 300 which are consistent with those discussed regarding the footwear 10, 100, and/or 200 are indicated herein by consistent reference numerals and, for sake of brevity, are not reintroduced nor described in detail; instead reference is made to the foregoing descriptions.

The footwear 300 is substantially similar to the footwear 200 discussed herein above. The main difference of the footwear 100 lies in the upper 114, the heel portion 140, and in the securement arrangement 163, which are now all addressed in turn.

The upper 114 of the footwear 300 continues upward in boot-like fashion to encase the ankle and perhaps a portion of the calf and/or shin of the wearer. In this way, the footwear 300 covers the entire foot and a portion of the lower leg of the wearer.

The heel portion 140 of the footwear 300 includes a heel cup 142 which is configured for receiving and retaining the heel of the wearer. The heel portion 140 further includes an upper portion 144 extending upward from the heel cup 142 and opposing side portions 146 and 148 extending at sides of the heel cup 142 to meet the lateral portion 36 and the medial portion 38, respectively, of the sole 12. The sides of the heel portion 140 each include an opening 150 formed through the sole 12 which exposes the upper 114. The opening 150 of the sole 12 allows articulation of the heel portion 40 and provides ventilation to the rear portion 18 of the footwear 300. The sides 146 and 148 and the upper portion 144 of the heel 140 essentially wrap the heel and a portion of the ankle of the wearer with the durable, protective material of the sole 12.

The securement arrangement 163 of the footwear 300 includes a strap 165 essentially similar to the strap 65 of the footwear 200 in that the strap 165 extends across the instep of the foot of the wearer. The securement arrangement further includes straps 167 and 169 extending, respectively, across the upper instep of the foot and around the ankle or lower leg portion of the wearer. The straps 165, 167, 169, like the strap 65, may be formed of any suitable material and may be fixed or removably attachable to the upper 14. In this respect, reference is made to the above description of the strap 65. Here, an Achilles portion 171 extends from the upper portion 144 of the sole 12 and engages the strap 169.

The upper 14 and 114 of the footwear 200 and 300, respectively, is formed of any type of pliable material suitable for providing both comfort and a degree of protection to the foot of the wearer. For example, the upper 14, 114 may comprise a cloth, a rubber material, a plastic material, neoprene, leather, a mesh material, etc., or a combination thereof, etc. The upper 14, 114 may sewn, stitched, adhered, etc. onto the sole 12. The sole 12 is formed of any material suitable for protecting the bottom of the wearer's feet and for providing sufficient flexibility for movement of the foot and toes. For example, the sole may be formed of a rubber material, a plastic material, leather, cloth, compressed EVA, polyurethane, etc., or a combination thereof, etc.

The inclusion of the insole 16 within the footwear 10, 100, 200, 300 has been made by way of example only. In another embodiment of the invention, the footwear does not include an insole as such. Instead, the upper 14 is disposed directly atop the sole 12 and the foot of the wearer residing in the footwear contacts the sole 12 directly. Alternatively and/or additionally, the sole 12 may include a thin layer of material, such as cloth, etc., affixed to the sole 12 for directly engaging the foot of the wearer.

Advantageously, the independent articuable toe portions of the footwear 10, 100, 200, 300 of the invention are configured to slightly separate the toes of a wearer. Particularly, the toe regions 30 which delimit tops of the toe portions 26 meet the toe portions 34 at the splits 28. This gathering of material disposed between the toe portions 26 serves to separate slightly the toes of the wearer thus providing a comfortable therapeutic effect to said toes.

Thus, a footwear is provided which protects the wearer from ground and surface hazards but yet allows increased touch, sensitivity, haptic response, and full foot and toe articulation in order to give the user the sense of going barefoot and the physiological benefits of unencumbered foot and toe articulation, while still wearing the footwear. That is, the footwear of the invention provides the wearer with the exhilarating freedom of going barefoot with the protection and surefooted grip of the contoured sole. The increased haptic response advantageously allows the wearer to become more aware of the ground surface underfoot and/or his/her natural surroundings. Wearing the footwear of the invention encourages improved balance, agility, and general foot health. That is, the footwear is particularly configured to mimic the natural shape, contours, and movement of the bare foot and thus promotes utilization of muscles, tendons, etc. without interference of bulky conventional shoe products.

Furthermore, the invention provides a footwear having individual fully articuable toe portions and including a sole contoured to precisely correspond to the shape of the foot, where the sole extends onto sides and/or tops of the various portions of the foot to provide protection thereto from outside contact. In on embodiment, the footwear includes only the upper disposed directly upon the sole without a mid-sole or the like disposed therebetween. The footwear optionally includes a protrusion formed in the forefoot portion such that a convexity protrudes upward within the footwear towards the upper to provide soothing contact with the foot and to encourage splaying of the toes during walking. These and other previously discussed features of the invention provide the wearer with the above-mentioned haptic and comfort benefits.

It will be apparent to those skilled in the art that, while exemplary embodiments have been shown and described, various modifications and variations can be made to the present apparatus and method disclosed herein without departing from the spirit or scope of the invention. Accordingly, it is to be understood that the various embodiments have been described by way of illustration and not limitation.

I claim:

1. Footwear, comprising:

a sole;

an upper; and a securement arrangement configured to secure the footwear to the foot of a wearer;

wherein the sole and the upper delimit individual toe portions configured to receive, retain, and allow independent articulation of corresponding individual toes of a foot inserted in the footwear;

wherein the sole includes contouring and curvature;

wherein the footwear further comprises a pad formed on a bottom of the sole; and wherein the contouring, curvature, and the pad intimately corresponds to the shape of the foot.

2. The footwear of claim 1, wherein the sole includes narrow slits cut into a bottom thereof disposed to provide an enhanced flexibility of the sole and to facilitate said independent articulation of the individual toe portions.

3. The footwear of claim 1, wherein the securement arrangement comprises a strap element disposed in engageable association with the upper so as to extend over an instep of a foot of a wearer.

4. The footwear of claim 3, wherein the securement arrangement further includes a heel cuff attached to the upper configured to wrap one or more of the heel, Achilles tendon, and ankle portion of the foot of the wearer.

5. The footwear of claim 1, wherein the upper extends over a foot, ankle, and lower shin and calf portion of a wearer.

6. The footwear of claim 1, wherein the toe portions of the sole include extensions which extend upward on front and sides of the toe portions to protect toes of the wearer from outside contact.

7. The footwear of claim 1, further comprising:

a front portion including the individual toe portions, a rear portion including a heel portion, a mid-foot portion disposed between the front and rear portions, a lateral portion at an outer side of the foot; and a medial portion at an inner side of the foot opposite from the lateral portion; and wherein said contouring and curvature delimits an arch at the mid-foot portion of the sole, the arch comprising a concave region at the medial side of the sole.

8. The footwear of claim 7, wherein said pad comprises a first area of increased thickness disposed on the sole at the heel portion, a second area of increased thickness disposed on the sole at a forefoot portion, and a third area of increased thickness disposed on the sole on each of the individual toe portions, wherein the forefoot portion is disposed between the front and mid-foot portions.

9. The footwear of claim 1, wherein the contouring and curvature of the sole comprises a concave arch disposed at a midfoot portion of the sole, and wherein the pad comprises a convex heal pad disposed at a rear portion of the sole and a convex fore-foot pad disposed at a fore-foot portion of the sole.

10. The footwear of claim 9, wherein pad further includes raised toe pads disposed at each of the individual toe portions.

11. The footwear of claim 1, wherein the sole includes a consistent thickness across the shoe and wherein the sole is shaped so as to mimic and trace the shape of the foot to form said contouring and curvature.

12. The footwear of claim 1, wherein the footwear comprises five of the individual toe portions.

* * * * *